US007849710B2

(12) United States Patent
De Larminat et al.

(10) Patent No.: US 7,849,710 B2
(45) Date of Patent: Dec. 14, 2010

(54) FALLING FILM EVAPORATOR

(75) Inventors: Paul De Larminat, Nantes (FR); Luc Le Cointe, Nantes (FR); John Francis Judge, Stewartstown, PA (US); Satheesh Kulankara, York, PA (US)

(73) Assignee: York International Corporation, York, PA (US)

( * ) Notice: Subject to any disclaimer, the term of this patent is extended or adjusted under 35 U.S.C. 154(b) by 424 days.

(21) Appl. No.: 11/248,652

(22) Filed: Oct. 12, 2005

(65) Prior Publication Data

US 2006/0080998 A1 Apr. 20, 2006

Related U.S. Application Data

(60) Provisional application No. 60/618,108, filed on Oct. 13, 2004.

(51) Int. Cl.
*F25B 39/02* (2006.01)

(52) U.S. Cl. ..... 62/515; 62/527

(58) Field of Classification Search ..... 62/515, 62/527, 498, 471, 525; 165/159, 157, 172, 165/115, 116, 117, 118, 158, 160, 161, 163
See application file for complete search history.

(56) References Cited

U.S. PATENT DOCUMENTS

| | | | | |
|---|---|---|---|---|
| 939,143 | A | | 11/1909 | Lillie |
| 2,012,183 | A | | 8/1934 | Carrier |
| 2,059,725 | A | * | 11/1936 | Carrier ..... 62/394 |
| 2,091,757 | A | | 8/1937 | Hanny |
| 2,384,413 | A | | 9/1945 | Zwickl |
| 2,411,097 | A | | 11/1946 | Kopp |
| 2,492,725 | A | | 12/1949 | Ashley |
| 3,004,396 | A | | 10/1961 | Endress et al. |
| 3,132,064 | A | | 5/1964 | Scheffers |
| 3,180,408 | A | | 4/1965 | Grotz, Jr. et al. |
| 3,191,396 | A | | 6/1965 | Ruddock |
| 3,197,387 | A | | 7/1965 | Lawrance |

(Continued)

FOREIGN PATENT DOCUMENTS

| | | |
|---|---|---|
| EP | 1 030 154 A2 | 8/2000 |
| GB | 2 161 256 A | 1/1986 |

OTHER PUBLICATIONS

Witt, "Spray Evaporator—Assembly and Instructions for the BVKF Models", Nov. 1, 1998, Figures p. 2.

*Primary Examiner*—Mohammad M Ali
(74) *Attorney, Agent, or Firm*—McNees Wallace & Nurick LLC

(57) ABSTRACT

A falling film evaporator is provided for use in a two-phase refrigeration system or process system. The evaporator includes a shell having an upper portion, a lower portion, and a tube bundle having tubes extending substantially horizontally in the shell. A hood is disposed over the tube bundle, the hood having an upper end adjacent the upper portion above the tube bundle, the upper end having opposed substantially parallel walls extending toward the lower portion, the walls terminating at an open end opposite the upper end. Once liquid refrigerant or liquid refrigerant and vapor refrigerant is deposited onto the tube bundle, the substantially parallel walls of the hood substantially prevent cross flow of refrigerant vapor or liquid and vapor between the tubes of the tube bundle.

19 Claims, 6 Drawing Sheets

U.S. PATENT DOCUMENTS 3,213,935 A 10/1965 Reid, Jr.
3,240,265 A 3/1966 Weller
3,259,181 A 7/1966 Ashley et al.
3,267,693 A 8/1966 Richardson et al.
3,276,217 A 10/1966 Bourne et al.
3,326,280 A 6/1967 Bosquain et al.
3,351,119 A 11/1967 Rosenblad
3,412,569 A 11/1968 Arledge, Jr.
3,635,040 A 1/1972 Morris, Jr.
3,735,811 A 5/1973 Moser et al.
3,775,993 A 12/1973 Murphy
3,831,390 A 8/1974 Hopkins
3,849,232 A 11/1974 Kessler et al.
4,154,642 A 5/1979 Mattern et al.
4,158,295 A * 6/1979 Sibley ..... 62/476
4,437,322 A 3/1984 Ertlinger
4,511,432 A 4/1985 Sephton
4,520,866 A 6/1985 Nakajima et al.
4,706,741 A * 11/1987 Bolmstedt et al. ..... 165/115
4,918,944 A 4/1990 Takahashi et al.
4,944,839 A 7/1990 Rosenblad
4,972,903 A 11/1990 Kwok
4,977,861 A 12/1990 Charbonnel et al.
5,044,427 A 9/1991 Love et al.
5,086,621 A 2/1992 Starner et al.
5,246,541 A 9/1993 Ryham
5,419,155 A 5/1995 Boehde et al.
5,461,883 A 10/1995 Terasaki
5,481,887 A 1/1996 Terasaki
5,561,987 A * 10/1996 Hartfield et al. ..... 62/471
5,575,889 A 11/1996 Rosenblad
5,588,596 A * 12/1996 Hartfield et al. ..... 239/542
5,638,691 A 6/1997 Hartfield et al.
5,645,124 A * 7/1997 Hartfield et al. ..... 165/117
5,791,404 A 8/1998 Bailey et al.
5,809,794 A * 9/1998 Sibik et al. ..... 62/204
5,839,294 A * 11/1998 Chiang et al. ..... 62/471
5,849,148 A 12/1998 Walker
5,922,903 A * 7/1999 Pujado ..... 562/98
5,931,020 A 8/1999 Nakamura
6,035,651 A 3/2000 Carey
6,089,312 A * 7/2000 Biar et al. ..... 165/118
6,127,571 A * 10/2000 Mulvaney, III ..... 562/98
6,167,713 B1 1/2001 Hartfield et al.
6,170,286 B1 1/2001 Keuper
6,233,967 B1 5/2001 Seewald et al.
6,253,571 B1 * 7/2001 Fujii et al. ..... 62/484
6,293,112 B1 * 9/2001 Moeykens et al. ..... 62/84
6,341,492 B1 * 1/2002 Carey ..... 62/84
6,357,239 B2 3/2002 Carey
6,357,254 B1 3/2002 Xia
6,516,627 B2 2/2003 Ring et al.
6,532,763 B1 3/2003 Gupte
6,596,244 B1 * 7/2003 Pujado ..... 422/198
6,606,882 B1 8/2003 Gupte
6,695,043 B1 2/2004 Wagner et al.
6,742,347 B1 6/2004 Kolk et al.
6,748,763 B2 * 6/2004 Schweigert et al. ..... 62/620
6,749,817 B1 * 6/2004 Mulvaney, III ..... 422/200
6,830,099 B2 * 12/2004 Moeykens ..... 165/115
6,830,654 B1 12/2004 Salmisuo
6,868,695 B1 3/2005 Dingel et al.
2002/0007639 A1 1/2002 Carey
2002/0137874 A1 9/2002 Hucks et al.
2002/0162352 A1 * 11/2002 Ring et al. ..... 62/471
2003/0230105 A1 12/2003 Lee
2004/0112573 A1 6/2004 Moeykens
2004/0245084 A1 12/2004 Bethge

* cited by examiner

FALLING FILM EVAPORATOR

BACKGROUND OF THE INVENTION

The present invention relates generally to the operation of an evaporator in a heating and cooling system or process system, and more specifically, to the operation of a falling film evaporator in a two-phase refrigerant heating and cooling system or process system.

Certain process systems, as well as heating and cooling systems for buildings or other structures that typically maintain temperature control in a structure, circulate a fluid within coiled tubes such that passing another fluid over the tubes effects a transfer of thermal energy between the two fluids. A primary component in such a heating and cooling system is an evaporator that includes a shell with a plurality of tubes forming a tube bundle through which a secondary fluid, such as water or ethylene glycol, is circulated. A primary fluid or refrigerant, such as R134a, is brought into contact with the outer or exterior surfaces of the tube bundle inside the evaporator shell resulting in a thermal energy transfer between the secondary fluid and the refrigerant. In a typical two-phase heating and cooling system, the refrigerant is heated and converted to a vapor state, which is then returned to a compressor where the vapor is compressed, to begin another refrigerant cycle. The secondary fluid, which has been cooled, is circulated to a plurality of coils located throughout the building. Warmer air is passed over the coils where the secondary fluid is being warmed while cooling the air for the building, and then returns to the evaporator be cooled again and to repeat the process.

Evaporators with refrigerant boiling outside the tubes include flooded evaporators, falling film evaporators and hybrid falling film evaporators. In conventional flooded evaporators, the shell is partially filled with a pool of boiling liquid refrigerant in which the tube bundle is immersed. Therefore, a considerable amount of the refrigerant fluid is required, which is costly to provide, and may be an environmental and/or safety concern, depending upon the composition of the refrigerant, in case of leakage of the refrigerant from the evaporator or from the whole system, in which the whole charge of refrigerant may be lost. Therefore, it is desired to reduce the charge of refrigerant in the system.

In a falling film evaporator, a dispenser deposits, such as by spraying, an amount of liquid refrigerant onto the surfaces of the tubes of the tube bundle from a position above the tube bundle, forming a layer (or film) of liquid refrigerant on the tube surface. The refrigerant in a liquid or two-phase liquid and vapor state contacts the upper tube surfaces of the tube bundle, and by force of gravity, falls vertically onto the tube surfaces of lower disposed tubes. Since the dispensed fluid layer is the source of the fluid that is in contact with the tube surfaces of the tube bundle, the amount of fluid required inside the shell is significantly reduced. However, there are technical challenges associated with the efficient operation of the falling film evaporator.

One challenge is that a portion of the fluid vaporizes and significantly expands in volume. The vaporized fluid expands in all directions, causing cross flow, or travel by the vaporized fluid in a direction that is transverse, or at least partially transverse to the vertical flow direction of the liquid fluid under the effect of gravity. Due to the cross flow disrupting the vertical flow of the fluid, at least a portion of the tubes, especially the lower positioned tubes of the tube bundle, receive insufficient wetting, providing significantly reduced heat transfer with the secondary fluid flowing inside those tubes in the tube bundle.

One attempted solution to this problem associated with falling film evaporators is U.S. Pat. No. 6,293,112 (the '112 patent). The '112 patent is directed to a falling film evaporator wherein the tubes of the tube bundle are arranged to form vapor lanes. The purpose of the vapor lanes is to provide access paths for the expanding vaporizing fluid so that the vertically downward flow of liquid refrigerant is not substantially impacted. In other words, the access paths are provided to reduce the effect of cross flow caused by expanding vaporizing fluid. Thus, the '112 patent has identified that cross flow caused by expanding vaporizing fluid necessarily occurs.

Another challenge is the compressor, which receives its supply of vaporized fluid from an outlet typically formed in the upper portion of the evaporator, can be damaged if the vaporized fluid contains entrained liquid droplets. Since the vaporized fluid adjacent the upper portion of the tube bundle typically contains these entrained liquid droplets, which would otherwise be drawn into the compressor, components must be implemented to provide separation between the vapor and liquid droplets. These components include, for example, a means to provide impingement of the liquid droplets, such as a baffle or mesh, a volume within the evaporator, which typically requires about one half of the volume of the evaporator, for gravity separation of the liquid droplets, or the impingement means in combination with the gravity separating volume. However, each of these components and combinations thereof add to the complexity and cost of the system, and may also result in an undesired pressure drop prior to the vapor refrigerant reaching the compressor.

A further challenge associated with falling film evaporators concerns the distributor, which is located in an upper portion of the evaporator shell. Refrigerant applied by the distributor at high pressure and/or two-phase liquid and vapor tends to generate mist and fine liquid droplets, in addition to those generated by the evaporation of the liquid on the tube bundle. Being generated in the upper portion of the evaporator shell, these droplets are easily entrained into compressor suction. Thus, many designs require a combination of a device to lower the pressure of the fluid before the distributors, and of a device to separate the vapor from the liquid before the distributor in order to very gently deposit liquid on top of the tube bundle.

A brochure produced by Witt GmbH, entitled "Instruction Guide for the BVKF type, updated November, 1998" is directed to a falling film evaporator that has a sheet metal hood with diverging walls positioned over the tube bundle and refrigerant distribution nozzles. The hood covers the tube bundle and extends partially along the sides of the bundle and directs refrigerant vapor with entrained droplets around the hood such that the droplets will have additional opportunity to separate from the gas flow as gas rises outside the hood toward the evaporator discharge. However, this concept does not prevent cross flow caused by expanding vaporizing fluid.

Finally, a hybrid falling film evaporator incorporates the attributes of a falling film evaporator and a flooded evaporator by immersing a lesser proportion of the tubes of the tube bundle than the flooded evaporator while still spraying fluid on the upper tubes, similar to a falling film evaporator.

What is needed is a falling film evaporator that substantially prevents cross flow caused by expanding vaporizing fluid and which also requires less space than a flooded evaporator for liquid droplet separation than a conventional flooded or existing designs of flooded film or hybrid evaporators.

SUMMARY OF THE INVENTION

The present invention is directed to a refrigeration system including a compressor, a condenser, an expansion device and an evaporator connected in a closed refrigerant loop. The evaporator includes a shell having an upper portion and a lower portion and a tube bundle, the tube bundle having a plurality of tubes extending substantially horizontally in the shell. A hood is disposed over the tube bundle, the hood having a closed end and an open end opposite the closed end, the closed end being disposed above the tube bundle adjacent the upper portion of the shell. The hood further has opposed substantially parallel walls extending from the closed portion toward the open portion of the shell. A refrigerant distributor is disposed below the hood and above the tube bundle, the refrigerant distributor being configured to deposit liquid refrigerant or liquid and vapor refrigerant onto the tube bundle. The substantially parallel walls of the hood substantially prevent cross flow of the refrigerant between the plurality of tubes of the tube bundle.

The present invention is further directed to a falling film evaporator for use in a refrigeration system including a shell having an upper portion and a lower portion. A tube bundle has a plurality of tubes extending substantially horizontally in the shell. A hood is disposed over the tube bundle, the hood having a closed end and an open end opposite the closed end, the closed end being disposed above the tube bundle adjacent the upper portion of the shell. The hood further has opposed substantially parallel walls extending from the closed portion toward the open portion of the shell. A refrigerant distributor is disposed below the hood and above the tube bundle, the refrigerant distributor being configured to deposit liquid refrigerant or liquid and vapor refrigerant onto the tube bundle. The substantially parallel walls of the hood substantially prevent cross flow of the refrigerant between the plurality of tubes of the tube bundle.

The present invention allows that the fluid distributor receives refrigerant at medium or high pressure, i.e., close to condensing pressure, and can be a two-phase liquid refrigerant and vapor refrigerant. Under these conditions, the refrigerant mist and droplets generated are contained below the hood and coalesced onto the tubes, as well as the roof and walls of the hood, to prevent the refrigerant mist and droplets from becoming entrained into the suction line.

The present invention is still further directed to a hybrid falling film evaporator for use in a refrigeration system including a shell having an upper portion and a lower portion. A lower tube bundle is in fluid communication with an upper tube bundle, the lower and upper tube bundles each having a plurality of tubes extending substantially horizontally in the shell, the lower tube bundle being at least partially submerged by refrigerant in the lower portion of the shell. A hood is disposed over the upper tube bundle, the hood having a closed end and an open end opposite the closed end, the closed end being adjacent the upper portion of the shell above the upper tube bundle. The hood further has opposed substantially parallel walls extending from the closed end toward the open end adjacent the lower portion of the shell. A refrigerant distributor is disposed above the upper tube bundle, the refrigerant distributor depositing refrigerant onto the upper tube bundle. The substantially parallel walls of the hood substantially prevent cross flow of refrigerant between the plurality of tubes of the upper tube bundle.

The present invention is yet further directed to a falling film evaporator for use in a control process including a shell having an upper portion and a lower portion. A tube bundle has a plurality of tubes extending substantially horizontally in the shell. A hood is disposed over the tube bundle, the hood having a closed end and an open end opposite the closed end, the closed end being disposed above the tube bundle adjacent the upper portion of the shell. The hood further has opposed substantially parallel walls extending toward the lower portion of the shell. A fluid distributor is disposed below the hood and above the tube bundle, the fluid distributor being configured to deposit liquid fluid or liquid and vapor fluid onto the tube bundle. The substantially parallel walls of the hood substantially prevent cross flow of the fluid between the plurality of tubes of the tube bundle.

An advantage of the present invention is that it substantially prevents cross flow caused by expanding vaporizing fluid, facilitating increased heat transfer with a minimum re-circulation rate.

A still further advantage of the present invention is that provides an efficient means of avoiding the carry-over of liquid droplets into the compressor suction.

A still further advantage of the present invention is that it is easy to manufacture and install.

A still yet further advantage of the present invention is that it can accommodate a mix of liquid and vapor at moderate or high pressure that is applied by the distributor over the tube bundle.

A further advantage of the present invention is that it can be used with either a falling film evaporator construction or a hybrid falling film evaporator construction.

Other features and advantages of the present invention will be apparent from the following more detailed description of the preferred embodiment, taken in conjunction with the accompanying drawings which illustrate, by way of example, the principles of the invention. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
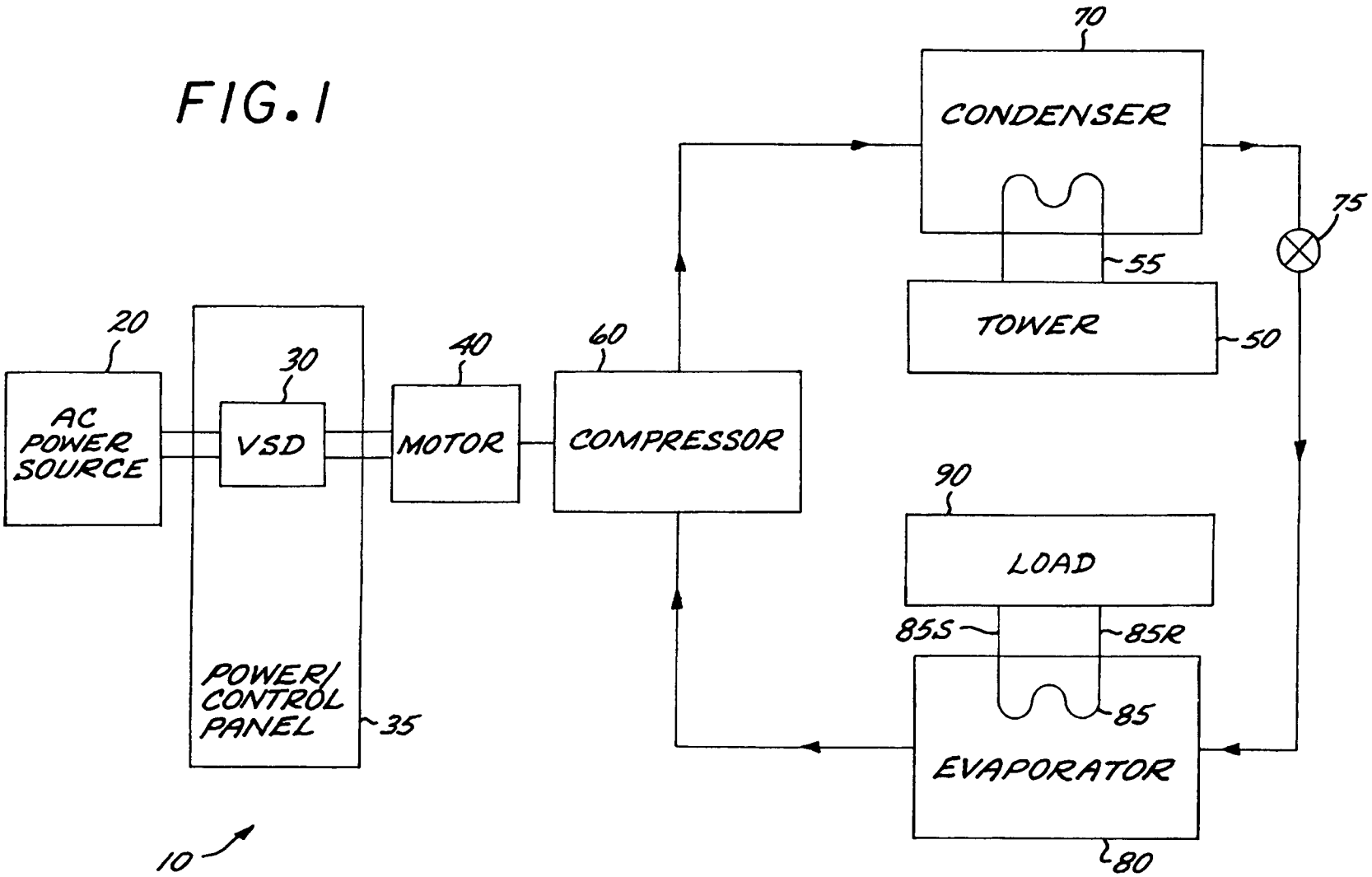
FIG. 1 is a schematic of a compressor system of the present invention.

FIG. 1 illustrates generally one system configuration of the present invention. A refrigeration or chiller system 10 includes an AC power source 20 that supplies a combination variable speed drive (VSD) 30 and power/control panel 35, which powers a motor 40 that drives a compressor 60, as controlled by the controls located within the power/control panel 35. It is appreciated that the term "refrigeration system" can include alternate constructions, such as a heat pump. In one embodiment of the invention, all of the components of the VSD 30 are contained within the power/control panel 35. The AC power source 20 provides single phase or multi-phase (e.g., three phase), fixed voltage, and fixed frequency AC power to the VSD 30 from an AC power grid or distribution system that is present at a site. The compressor 60 compresses a refrigerant vapor and delivers the vapor to the condenser 70 through a discharge line. The compressor 60 can be any suitable type of compressor, e.g., centrifugal compressor, reciprocating compressor, screw compressor, scroll compressor, etc. The refrigerant vapor delivered by the compressor 60 to the condenser 70 enters into a heat exchange relationship with a fluid, preferably water, flowing through a heat-exchanger coil or tube bundle 55 connected to a cooling tower 50. However, it is to be understood that condenser 70 can be air-cooled or can use any other condenser technology. The refrigerant vapor in the condenser 70 undergoes a phase change to a refrigerant liquid as a result of the heat exchange relationship with the liquid in the heat-exchanger coil 55. The condensed liquid refrigerant from condenser 70 flows to an expansion device 75, which greatly lowers the temperature and pressure of the refrigerant before entering the evaporator 80. Alternately, most of the expansion can occur in a nozzle 108 (FIGS. 2-7) when used as a pressure adjustment device. A fluid circulated in heat exchange relationship with the evaporator 80 can then provide cooling to an interior space.

The evaporator 80 can include a heat-exchanger coil 85 having a supply line 85S and a return line 85R connected to a cooling load 90. The heat-exchanger coil 85 can include a plurality of tube bundles within the evaporator 80. Water or any other suitable secondary refrigerant, e.g., ethylene, ethylene glycol, or calcium chloride brine, travels into the evaporator 80 via return line 85R and exits the evaporator 80 via supply line 85S. The liquid refrigerant in the evaporator 80 enters into a heat exchange relationship with the water in the heat-exchanger coil 85 to chill the temperature of the secondary refrigerant in the heat-exchanger coil 85. The refrigerant liquid in the evaporator 80 undergoes a phase change to a refrigerant vapor as a result of the heat exchange relationship with the liquid in the heat-exchanger coil 85. The vapor refrigerant in the evaporator 80 then returns to the compressor 60 to complete the cycle.

It is noted that the chiller system 10 of the present invention may use a plurality of any combination of VSDs 30, motors 40, compressors 60, condensers 70, and evaporators 80.

Figure 2:
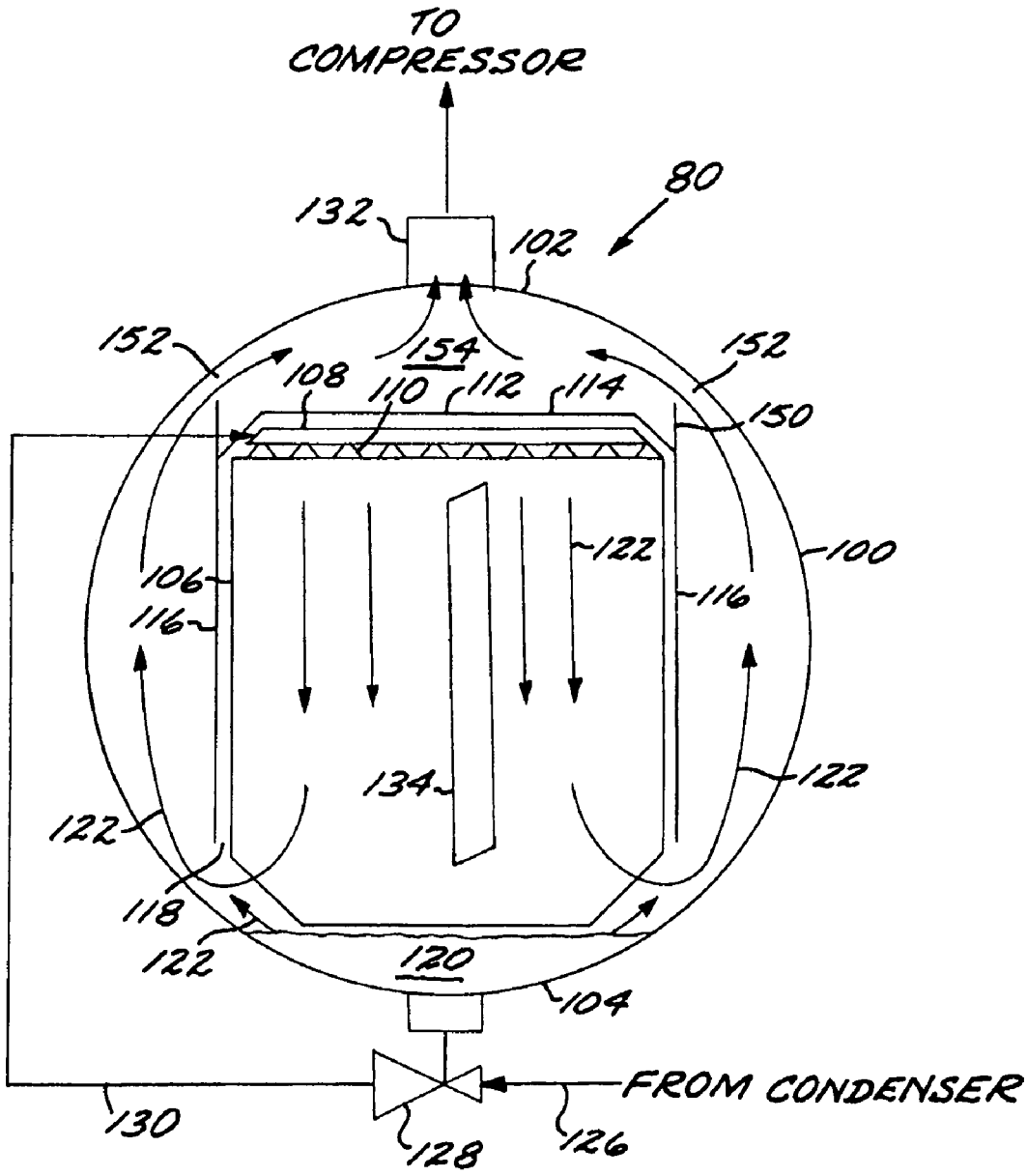
FIG. 2 is a cross section of an embodiment of a falling film evaporator of the present invention.
Figure 3:
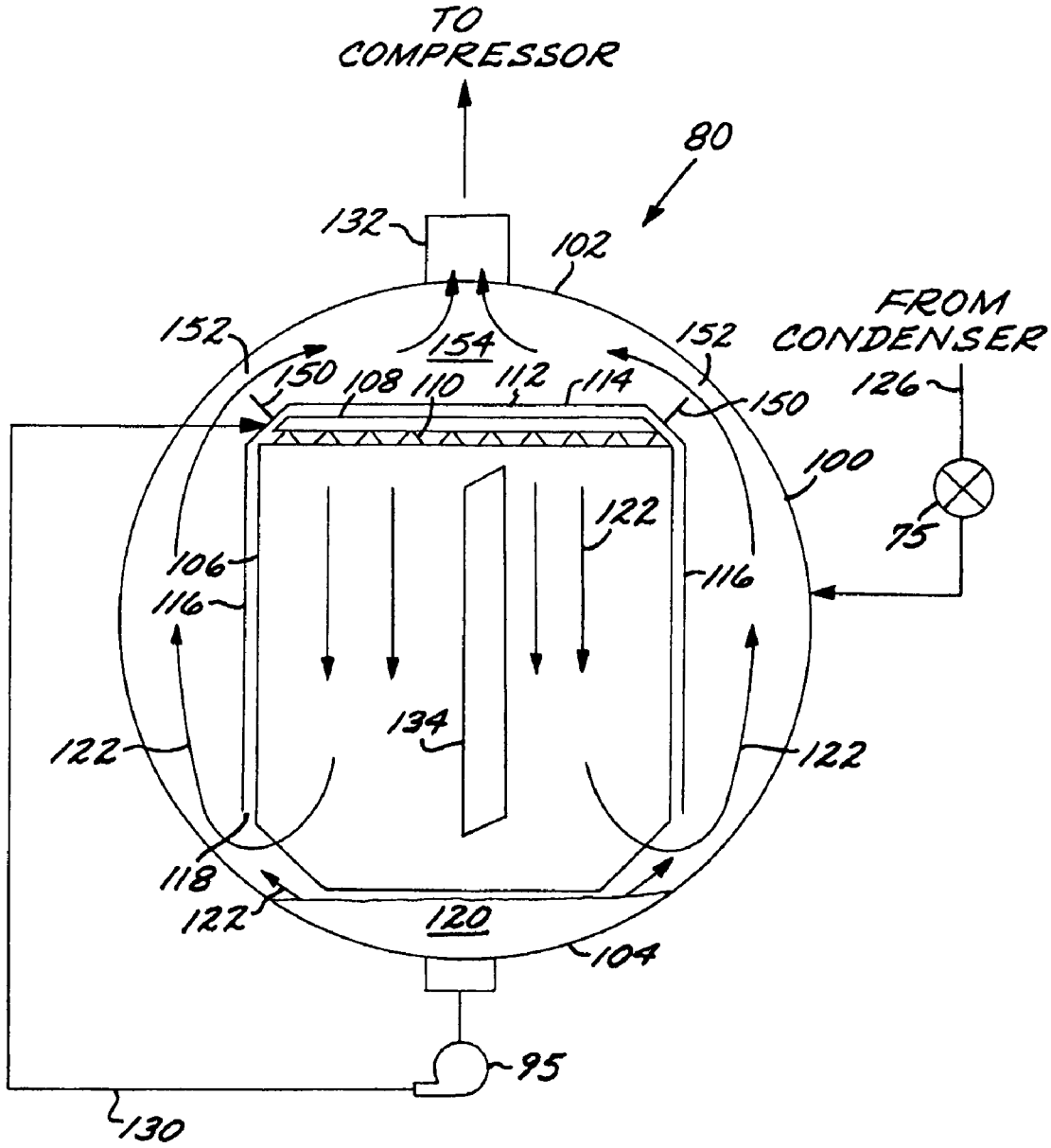
FIGS. 3-4 are cross sections of alternate embodiments of a falling film evaporator of the present invention.
Figure 4:
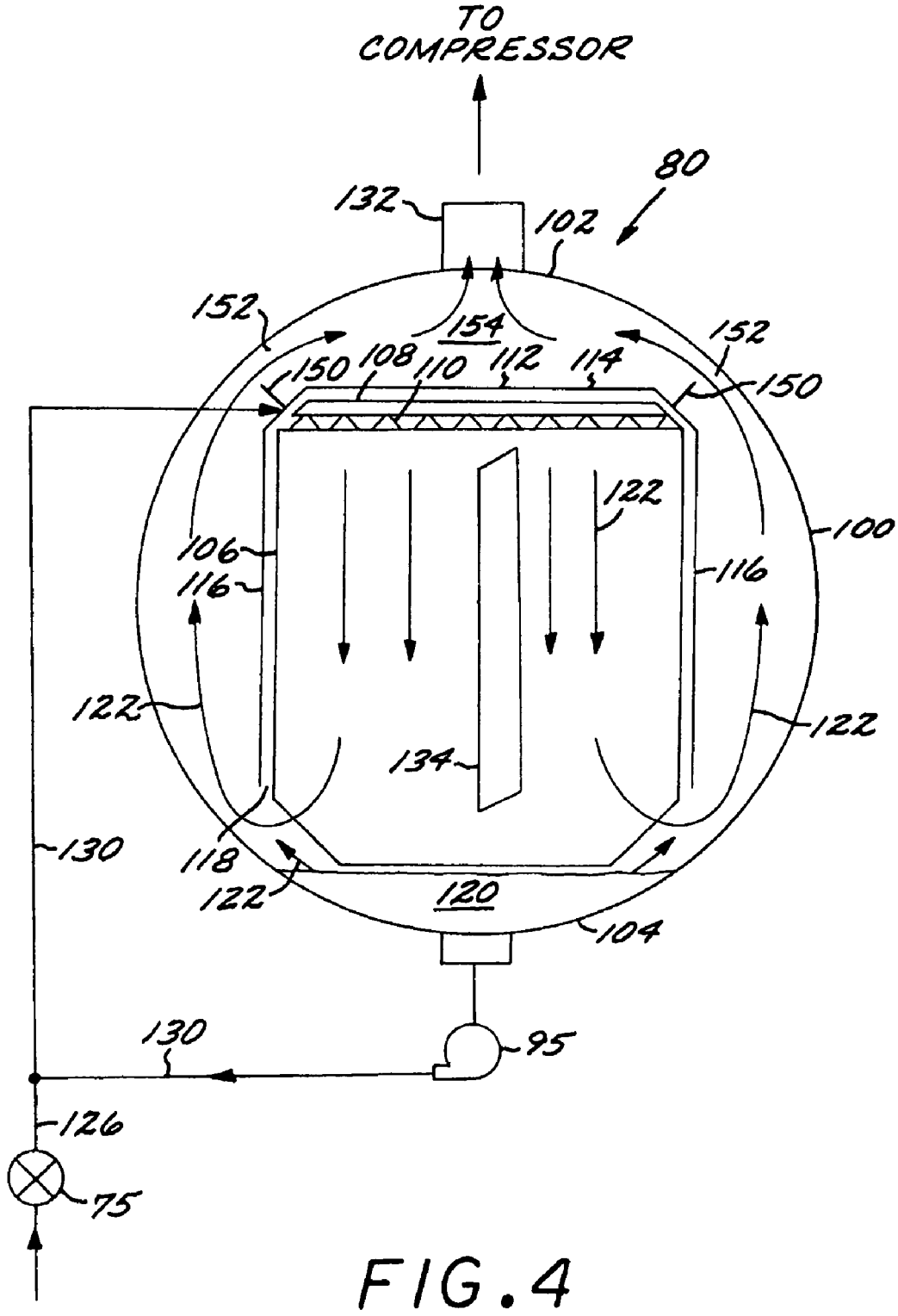

Referring to FIG. 2, one embodiment of evaporator 80 is a falling film evaporator. In this embodiment, evaporator 80 includes a substantially cylindrical shell 100 having an upper portion 102 and a lower portion 104 with a plurality of tubes forming a tube bundle 106 extending substantially horizontally along the length of the shell 100. A suitable fluid, such as water, ethylene, ethylene glycol, or calcium chloride brine flows through the tubes of the tube bundle 106. A distributor 108 disposed above the tube bundle 106 distributes refrigerant fluid, such as R134a received from the condenser 126 that is in a liquid state or a two-phase liquid and vapor state, onto the upper tubes in the tube bundle 106. In other words, the refrigerant fluid can be in a two-phase state, i.e., liquid and vapor refrigerant. In FIG. 3, the refrigerant delivered to the distributor 108 is entirely liquid. In FIGS. 2, 4-6, the refrigerant delivered to the distributor 108 can be entirely liquid or a two-phase mixture of liquid and vapor. Liquid refrigerant that has been directed through the tubes of the tube bundle 106 without changing state collects adjacent the lower portion 104, this collected liquid refrigerant being designated as liquid refrigerant 120. Although a pump 95 can be used to re-circulate liquid refrigerant 120 from the lower portion 104 to the distributor 108 (FIGS. 3 and 4), an ejector 128 can be employed to draw the liquid refrigerant 120 from the lower portion 104 using the pressurized refrigerant from condenser 126, which operates by virtue of the Bernoulli effect, as shown in FIG. 2. In addition, while the level of the liquid refrigerant 120 is shown as being below the tube bundle 106 (e.g., FIGS. 2-4), it is to be understood that the level of the liquid refrigerant 120 may immerse a portion of the tubes of the tube bundle 106.

Further referring to FIG. 2, a hood 112 is disposed over the tube bundle 106 to substantially prevent cross flow of vapor refrigerant or of liquid and vapor refrigerant between the tubes of the tube bundle 106. The hood 112 includes an upper end 114 adjacent the upper portion 102 of the shell 100 above the tube bundle 106 and above the distributor 108. Extending from opposite ends of the upper end 114 toward the lower portion 104 of the shell 100 are opposed substantially parallel walls 116, preferably the walls 116 extending substantially vertically and terminating at an open end 118 that is substantially opposite the upper end 114. Preferably, the upper end 114 and parallel walls 116 are closely disposed adjacent to the tubes of the tube bundle 106, with the parallel walls 116 extending sufficiently toward the lower portion 104 of the shell 100 as to substantially laterally surround the tubes of the tube bundle 106. However, it is not required that the parallel walls 116 extend vertically past the lower tubes of the tube bundle 106, nor is it required that the parallel walls 116 are planar, although vapor refrigerant 122 that forms within the outline of the tube bundle 106 is channeled substantially vertically within the confines of the parallel walls 116 and through the open end 118 of the hood 112. The hood 112 forces the vapor refrigerant 122 downward between the walls 116 and through the open end 118, then upward in the space between the shell 100 and the walls 116 from the lower portion 104 of the shell 100 to the upper portion 102 of the shell 100. The vapor refrigerant 122 then flows over a pair of extensions 150 protruding adjacent to the upper end 114 of the parallel walls 116 and into a suction channel 154. The vapor refrigerant 122 enters into the suction channel 154 through slots 152 which are spaces between the ends of the extensions 150 and the shell 100 that define slots 152, before exiting the evaporator 80 at an outlet 132 that is connected to the compressor 60.

Refrigerant 126 that is received from the condenser 70 and the lower portion 104 of the shell 100 (liquid refrigerant 120) is directed through the distributor 108 and preferably deposited from a plurality of positions 110 onto the upper tubes of the tube bundle 106. These positions 110 can include any combination of longitudinal or lateral positions with respect to the tube bundle 106. In a preferred embodiment, distributor 108 includes a plurality of nozzles supplied by a liquid ramp that is supplied by the condenser 70. The nozzles preferably apply a predetermined jet pattern so that the upper row of tubes are covered. An amount of the refrigerant boils by virtue of the heat exchange that occurs along the tube surfaces of the tube bundle 106. This expanding vapor refrigerant 122 is directed downwardly toward the open end 118 since the upper end 114 of the hood 112 and substantially parallel walls 116 provide no alternate escape path. Since the substantially parallel walls 116 are preferably adjacent to the outer column of tubes of the tube bundle 106, vapor refrigerant 122 is forced substantially vertically downward, substantially preventing the possibility of cross flow of the vapor refrigerant 122 inside the hood 112. The tubes of the tube bundle 106 are arranged to promote the flow of refrigerant in the form of a film around the tube surfaces, the liquid refrigerant coalescing to form droplets or, in some instances, a curtain or sheet of liquid refrigerant at the bottom of the tube surfaces. The resulting sheeting promotes wetting of the tube surfaces which enhances the heat transfer efficiency between the fluid flowing inside the tubes of the tube bundle 106 and the refrigerant flowing around the surfaces of the tubes of the tube bundle 106.

Unlike current systems, the upper end 114 of the hood 112 substantially prevents the flow of applied refrigerant 110, in the form of vapor and mist, at the top of the tube bundle 106 from flowing directly to the outlet 132 which is fed to the compressor 60. Instead, by directing the refrigerant 122 to have a downwardly directed flow, the vapor refrigerant 122 must travel downward through the length of the substantially parallel walls 116 before the refrigerant can pass through the open end 118. After the vapor refrigerant 122 passes the open end 118 which contains an abrupt change in direction, the vapor refrigerant 122 is forced to travel between the hood 112 and the inner surface of the shell 100. This abrupt directional change results in a great proportion of any entrained droplets of refrigerant to collide with either the liquid refrigerant 120 or the shell 100 or hood 112, removing those droplets from the vapor refrigerant 122 flow. Also, refrigerant mist traveling the length of the substantially parallel walls 116 is coalesced into larger drops that are more easily separated by gravity, or evaporated by heat transfer on the tube bundle 106.

Once the vapor refrigerant 122 passes through the parallel walls 116 of the hood 112, the vapor refrigerant 122 then flows from the lower portion 104 to the upper portion 102 along the prescribed narrow passageway, and preferably substantially symmetric passageways, formed between the surfaces of the hood 112 and the shell 100 prior to reaching the outlet 132. As a result of the increased drop size, the efficiency of liquid separation by gravity is improved, permitting an increased upward velocity of vapor refrigerant 122 flow through the evaporator. A baffle is provided adjacent the evaporator outlet to prevent a direct path of the vapor refrigerant 122 to the compressor inlet. The baffle includes slots 152 defined by the spacing between the ends of extensions 150 and the shell 100. The combination of the substantially parallel walls 116, narrow passageways and slots 152 in the evaporator 80 removes virtually all the remaining entrained droplets from the vaporized refrigerant 122.

By substantially eliminating cross flow of vapor refrigerant and coalesced drops of liquid refrigerant along tube bundle 106, the amount of refrigerant 120 that must be recirculated can be reduced. It is the reduction of the amount of recirculated refrigerant flow that can enable the use of ejector 128, versus a conventional pump. The ejector 128 combines the functions of an expansion device and a refrigerant pump. In addition, it is possible to incorporate all expansion functionality into the distributor 108 nozzles. Preferably, two expansion devices are employed: a first expansion device being incorporated into spraying nozzles of the distributor 108. A second expansion device can also be a partial expansion in the liquid line 130, such as a fixed orifice, or alternately, a valve controlled by the level of liquid refrigerant 120, to account for variations in operating conditions, such as evaporating and condensing pressures, as well as partial cooling loads. Further, it is also preferable that most of the expansion occurs in the nozzles, providing a greater pressure difference, while simultaneously permitting the nozzles to be of reduced size, thereby reducing the size and cost of the nozzles.

Figure 5:
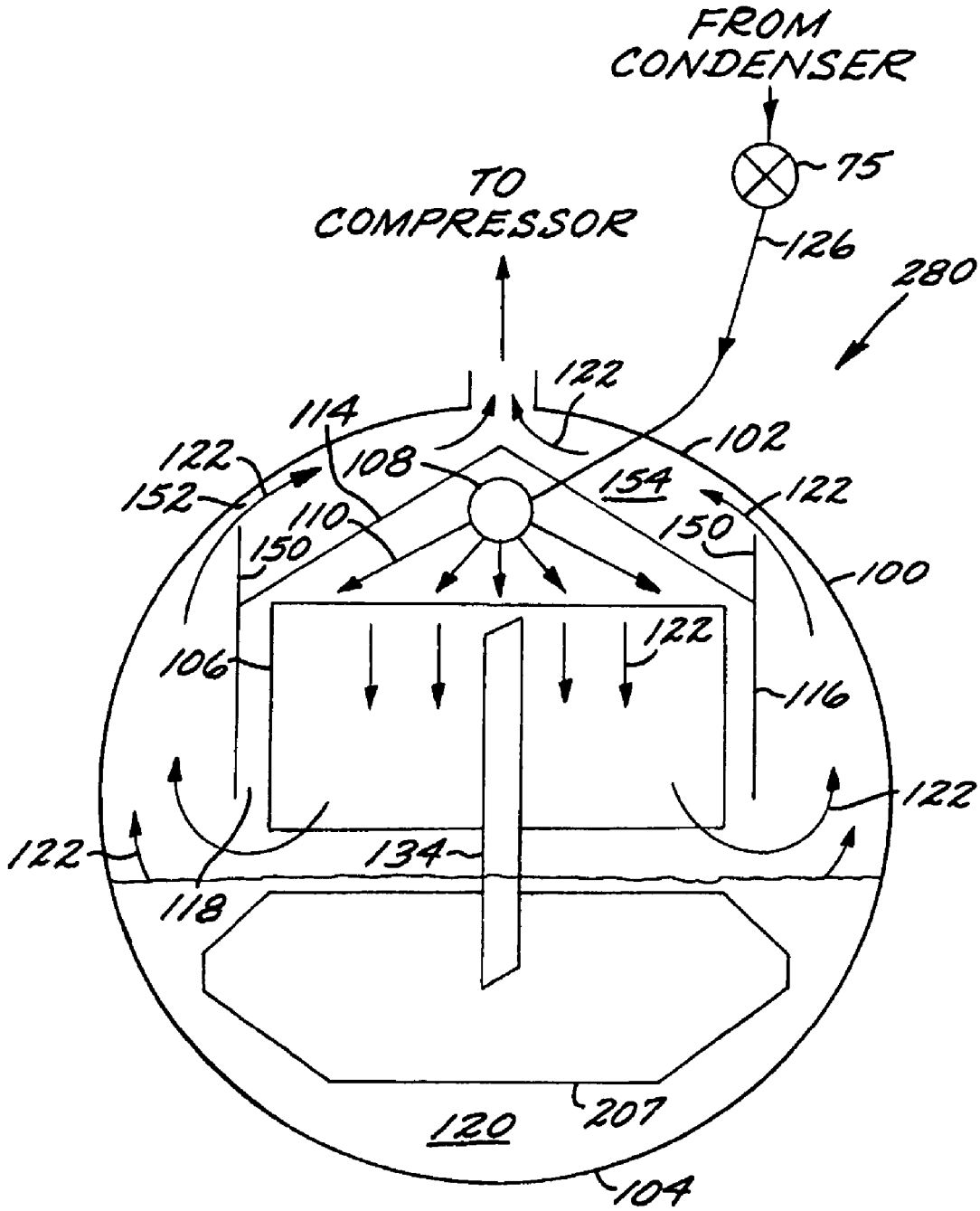
FIG. 5 is a cross section of an embodiment of a hybrid falling film evaporator of the present invention.
Figure 6:
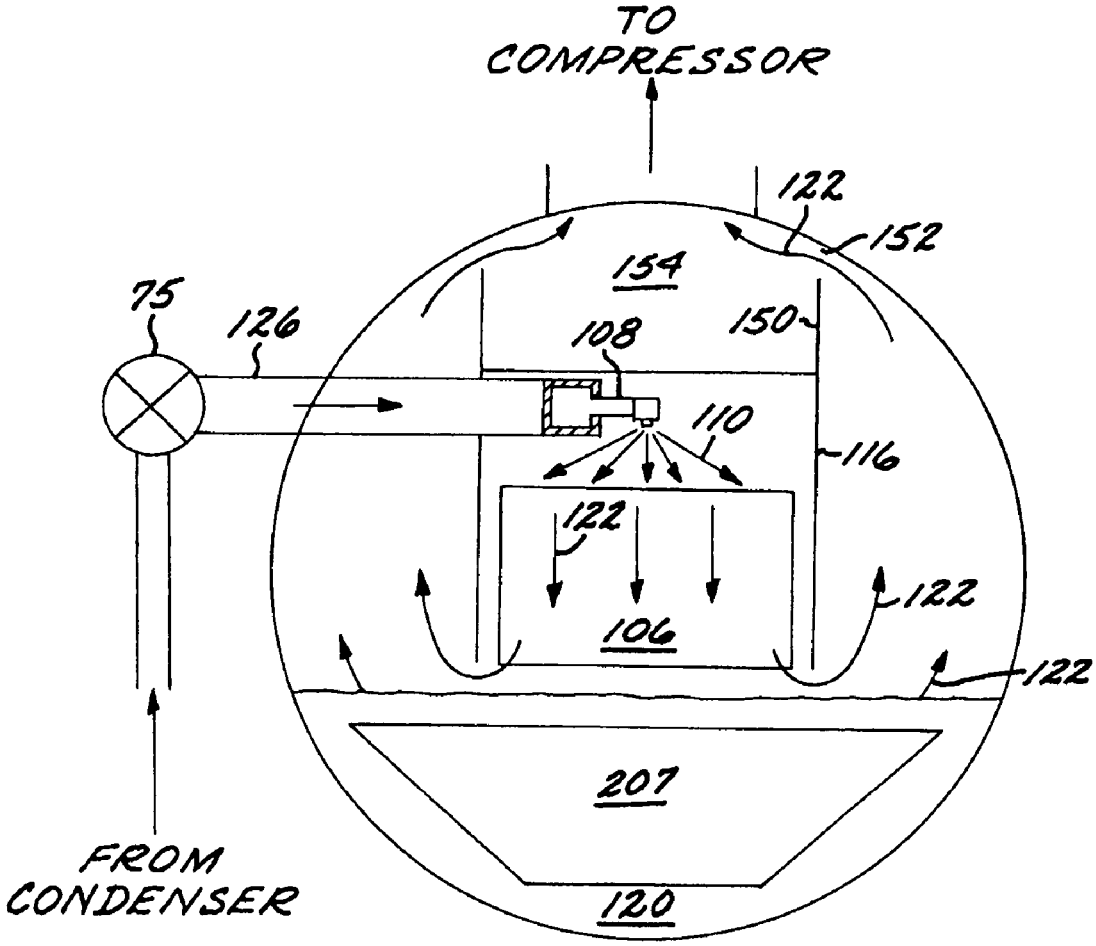
FIG. 6 is a cross section of a further embodiment of a hybrid falling film evaporator of the present invention.

Referring to FIG. 5, an embodiment of a hybrid falling film evaporator 280 is presented which includes an immersed or at least partially immersed tube bundle 207 in addition to a tube bundle 106. Except as discussed, corresponding components in evaporator 280 are otherwise similar to evaporator 80. Preferably, evaporator 280 incorporates a two pass system in which fluid that is to be cooled first flows inside the tubes of lower tube bundle 207 and then is directed to flow inside the tubes of the upper tube bundle 106. Since the second pass of the two pass system occurs on the top tube bundle 106, the temperature of the fluid flowing in the tube bundle 106 is reduced, requiring a lesser amount of refrigerant flow over the surfaces of the tube bundle 106. Thus, there is no need to re-circulate refrigerant 120 to the distributor 108. Also, the bundle 207 evaporates the extra refrigerant dropping from tube bundle 106. If there is no recirculation device, e.g., pump or ejector, the falling film evaporator must be a hybrid.

It is to be understood that although a two pass system is described in which the first pass is associated with an at least partially immersed (flooded) lower tube bundle 207 and the second pass associated with upper tube bundle 106 (falling film), other arrangements are contemplated. For example, the evaporator can incorporate a one pass system with any percentage of flooding associated with lower tube bundle 207, the remaining portion of the one pass associated with upper tube bundle 106. Alternately, the evaporator can incorporate a three pass system in which two passes are associated with lower tube bundle 207 and the remaining pass associated with upper tube bundle 106, or in which one pass is associated with lower tube bundle 207 and its remaining two passes are associated with upper tube bundle 106. Further, the evaporator can incorporate a two pass system in which one pass is associated with upper tube portion 106 and the second pass is associated with both the upper tube portion 106 and the lower tube portion 207. In summary, any number of passes in which each pass can be associated with one or both of the upper tube bundle and the lower tube bundle is contemplated.

While embodiments have been directed to refrigeration systems, the evaporator of the present invention can also be used with process systems, such as a chemical process involving a blend of two components, one being volatile such as in the petrochemical industry. Alternately, the process system could relate to the food processing industry. For example, the evaporator of the present invention could be used to control a juice concentration. Referring to FIG. 2, a juice (e.g., orange juice) fed through the fluid distributor 108 is heated, a portion becoming vapor, while the liquid 120 accumulating at the lower portion of the evaporator contains a higher concentration of juice. One skilled in the art can appreciate that the evaporator can be used for other process systems.

While it is preferred that the walls 116 are parallel, it is also preferred that the walls 116 are symmetric about a central vertical plane 134 bisecting the upper and lower portions 102, 104, since the tube bundle 106 arrangements are typically similarly symmetric.

The arrangement of tubes in tube bundles 106 is not shown, although a typical arrangement is defined by a plurality of uniformly spaced tubes that are aligned vertically and horizontally, forming an outline that can be substantially rectangular. However, a stacking arrangement wherein the tubes are neither vertically or horizontally aligned may also be used, as well as arrangements that are not uniformly spaced.

In addition or in combination with other features of the present invention, different tube bundle constructions are contemplated. For example, it is possible to reduce the volume of the shell 100 if the refrigerant is deposited by the distributor 108 at wide angles. However, such wide angles can create deposited refrigerant having horizontal velocity components, possibly generating an uneven longitudinal liquid distribution. To address this issue, finned tubes (not shown), as are known in the art, can be used along the uppermost horizontal row or uppermost portion of the tube bundle 106. Besides possibly using finned tubes on top, the straightforward approach is to use new generation enhanced tube developed for pool boiling in flooded evaporators. Additionally, or in combination with the finned tubes, porous coatings, as are known in the art, can also be applied to the outer surface of the tubes of the tube bundles 106.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An evaporator for use in a refrigeration system comprising:

a shell;

an outlet connection for vapor configured to be connectable to a compressor;

a first plurality of tubes configured to operate in at least an immersed mode in a continuous liquid mass;

a second plurality of tubes configured to operate in a falling film mode;

a hood;

a distributor;

wherein the second plurality of tubes is at least partially above the first plurality of tubes;

wherein the first plurality of tubes and the second plurality of tubes each extend substantially horizontally in the shell;

wherein the distributor is positioned above the second plurality of tubes; and wherein the hood overlies and substantially laterally surrounds substantially all of the second plurality of tubes, the hood further being symmetric about a vertical plane, the vertical plane bisecting the shell.

2. The evaporator of claim 1 wherein a tube of the first plurality of tubes is finned.

3. The evaporator of claim 1 wherein at least one tube of the second plurality of tubes includes a porous coating applied to a portion of an outer surface of the at least one tube.

4. The evaporator of claim 1 further including an ejector that provides flow of refrigerant to the distributor.

5. The evaporator of claim 1 wherein the distributor is configured to expand the refrigerant.

6. The evaporator of claim 1 wherein a fluid flowing in the first plurality of tubes and the second plurality of tubes is subjected to a two pass system in which the fluid first flows inside the first plurality of tubes during a first pass, then the fluid flows inside the second plurality of tubes during a second pass.

7. The evaporator of claim 1 wherein a fluid flowing in the first plurality of tubes and the second plurality of tubes is subjected to a one pass system in which the fluid flows inside at least one tube of each of the first plurality of tubes and the second plurality of tubes.

8. The evaporator of claim 1 wherein a fluid flowing in the first plurality of tubes and the second plurality of tubes is subjected to a two pass system in which the fluid first flows inside the second plurality of tubes during a first pass, then the fluid flows inside the first plurality of tubes during a second pass.

9. The evaporator of claim 5 wherein the distributor includes a nozzle.

10. An evaporator for use in a refrigeration system configured to distribute refrigerant within the evaporator comprising:

a shell;

an outlet connection for vapor configured to be connectable to a compressor;

a hood;

a distributor;

a multiple pass system comprising a plurality of tubes configured to operate in a falling film mode and extending substantially horizontally in the shell;

wherein the hood overlies and substantially laterally surrounds substantially all of at least one fluid pass of the multiple pass system, the hood further being symmetric about a vertical plane, the vertical plane bisecting the shell; and wherein the distributor is positioned above the fluid pass.

11. The evaporator of claim 10 wherein the hood comprises a first portion and a second portion so that the first portion and the second portion substantially laterally surround a fluid pass of the multiple pass system.

12. The evaporator of claim 11 wherein the first portion and the second portion are substantially parallel to each other.

13. The evaporator of claim 12 wherein the first portion and the second portion extend substantially vertically.

14. The evaporator of claim 13 wherein the substantially parallel portions substantially laterally surround the fluid pass of the multiple pass system.

15. An evaporator for use in a refrigeration system configured to distribute refrigerant within the evaporator comprising:

a shell;

an outlet connection for vapor configured to be connectable to a compressor;

a hood;

a distributor;

a one pass system comprising a plurality of tubes configured to operate in a falling film mode and extending substantially horizontally in the shell;

wherein the hood overlies and substantially laterally surrounds substantially all of the one pass system, the hood further being symmetric about a vertical plane, the vertical plane bisecting the shell; and wherein the distributor is positioned above the fluid pass.

16. The evaporator of claim 15 wherein the hood comprises a first portion and a second portion so that each portion substantially laterally surrounds a fluid pass of the one pass system.

17. The evaporator of claim 16 wherein the first portion and the second portion are substantially parallel to each other.

18. The evaporator of claim 17 wherein the first portion and a second portion extend substantially vertically.

19. An evaporator for use in a refrigeration system comprising:

a shell;

an outlet connection for vapor configured to be connectable to a compressor;

a first plurality of tubes configured to operate in at least an immersed mode in a continuous boiling liquid mass;

a second plurality of tubes configured to operate in a falling film mode in which there is bulk refrigerant flow in the direction of gravity;

a hood;

a distributor;

wherein the second plurality of tubes is at least partially above the first plurality of tubes;

wherein the first plurality of tubes and the second plurality of tubes each extend substantially horizontally in the shell;

wherein the distributor is positioned above the second plurality of tubes; and wherein the hood overlies and substantially laterally borders substantially all of the second plurality of tubes, the hood further being symmetric about a vertical plane, the vertical plane bisecting the shell.

* * * * *